US006188165B1

(12) United States Patent
Lee

(10) Patent No.: US 6,188,165 B1
(45) Date of Patent: Feb. 13, 2001

(54) COOLANT BUFFERING APPARATUS FOR CRT ASSEMBLY

(75) Inventor: Jong-hoon Lee, Suwon (KR)

(73) Assignee: Samsung Electronics Co., Ltd., Kyungki-do (KR)

( * ) Notice: Under 35 U.S.C. 154(b), the term of this patent shall be extended for 0 days.

(21) Appl. No.: 09/182,208

(22) Filed: Oct. 30, 1998

(30) Foreign Application Priority Data

Nov. 21, 1997 (KR) ..... 97-62045

(51) Int. Cl.[7] ..... H01J 29/89

(52) U.S. Cl. ..... 313/44; 313/35; 313/46; 348/749

(58) Field of Search ..... 348/744, 748, 348/749; 313/23, 35, 44, 33, 34, 46

(56) References Cited

U.S. PATENT DOCUMENTS 4,035,230 * 7/1977 Bevilacqua ..... 175/36 R
4,777,532 * 10/1988 Hasegawa ..... 358/231
4,982,289 * 1/1991 Mitani et al. ..... 358/237

FOREIGN PATENT DOCUMENTS 4-101335 * 4/1992 (JP) ..... 313/35
4-171637 * 4/1992 (JP) ..... 313/35

* cited by examiner

*Primary Examiner*—Ashok Patel
(74) *Attorney, Agent, or Firm*—Sughrue, Mion, Zinn, Macpeak & Seas, PLLC

(57) ABSTRACT

A coolant buffering apparatus of a CRT that buffers expansions and contractions of a coolant held in a coupler installed between the CRT and a projection lens unit. The apparatus has a cylinder connected to the coupler so that coolant in the coupler can flow into the cylinder, a piston assembly installed to be operative to reciprocate in the cylinder and pushed in a direction away from the coupler as coolant expands, and a spring for elastically biasing the piston assembly toward the coupler when the coolant contracts.

6 Claims, 4 Drawing Sheets

COOLANT BUFFERING APPARATUS FOR CRT ASSEMBLY

BACKGROUND OF THE INVENTION

1. Field of the Invention

The present invention relates to a coolant buffering apparatus of a CRT (cathode ray tube) assembly and, more particularly, to a coolant buffering apparatus of a CRT assembly having an improved structure to buffer an expanding and contracting coolant.

2. Description of the Related Art

In general, in a CRT assembly, such as a projection TV, the fluorescent surface of the CRT may be damaged due to heat generated by the CRT. Accordingly, a cooling device is employed in the CRT assembly which uses a coolant such as ethylene glycol or glycerin. Also, to buffer expansion and contraction of the coolant, a coolant buffer must be provided with the cooling device.

FIGS. 1 and 2 show a conventional CRT assembly having a coolant buffering apparatus. Referring to the drawings, a CRT assembly has a coupler 40 for cooling a CRT 10 installed between the CRT 10 and a projection lens unit 20. The coupler 40 contains a coolant 30 and a plurality of radiating fins 41 are formed on the outer surface of the coupler 40. Rubber rings 14 and 24 forming a seal between the CRT 10, the coupler 40 and the projection lens unit 20 are disposed between the CRT 10 and the coupler 40, and the coupler 40 and the projection lens unit 20, respectively. The coolant 30 is injected via an inlet (not shown) formed by piercing the coupler 40 and then held in a containing portion 42. The inlet is sealed by an additional sealing means (not shown).

In the conventional CRT assembly, a coolant buffering apparatus 50 is installed in a buffer path 43 which is connected to the coupler 40 in order to buffer the coolant 30 which repeatedly expands and contracts according to changes in the temperature of the CRT 10. The coolant buffering apparatus 50 includes a rubber bellows 51 of a hemispheric shape inserted in the buffer path 43 and a protective cap 52, installed on the rubber bellows 51, for protecting the rubber bellows 51 from being damaged when the coolant 30 expands.

The coolant buffering apparatus 50 and the projection lens unit 20 can be sealed between them and coupled to the coupler 40 by a sealing bracket 60.

In the conventional coolant buffering apparatus having the above structure, however, as the coolant 30 repeatedly expands and contracts, the rubber bellows 51 can easily tear.

SUMMARY OF THE INVENTION

To solve the above problem, it is an objective of the present invention to provide a coolant buffering apparatus of a CRT assembly having an improved structure to buffer a coolant during repeated expansions and contractions.

Accordingly, to achieve the above objective, there is provided a coolant buffering apparatus of a CRT for buffering expansions and contractions of a coolant held in a coupler installed between the CRT and a projection lens unit, which comprises a cylinder connected to the coupler to accept coolant flowing from the coupler, a piston assembly installed within the cylinder and operative to reciprocate in the cylinder and being pushed in a direction away from the coupler in the cylinder as the coolant expands, and a spring for elastically biasing the piston assembly toward the coupler as the coolant contracts.

Preferably, the coolant buffering apparatus of a CRT further comprises a cylinder cover coupled to the end of the cylinder opposite the coupler and a rubber ring disposed between the coupler and the cylinder to seal the coupler and the cylinder.

Further, it is preferable that the piston assembly comprises a piston head coupled to the piston ring, a rod having one end thereof coupled to the piston head and reciprocating in the cylinder, and a cap inserted around and fixed to the other end of the rod.

Also, it is preferable that the coolant buffering apparatus of a CRT further comprises at least one piston ring provided at the outer circumferential surface of the piston head which contacts the inner circumferential surface of the cylinder to prevent the coolant from leaking.

BRIEF DESCRIPTION OF THE DRAWINGS

The above objective and advantages of the present invention will become more apparent by describing in detail a preferred embodiment thereof with reference to the accompanying drawings, in which.

DETAILED DESCRIPTION OF THE INVENTION

Figure 1:
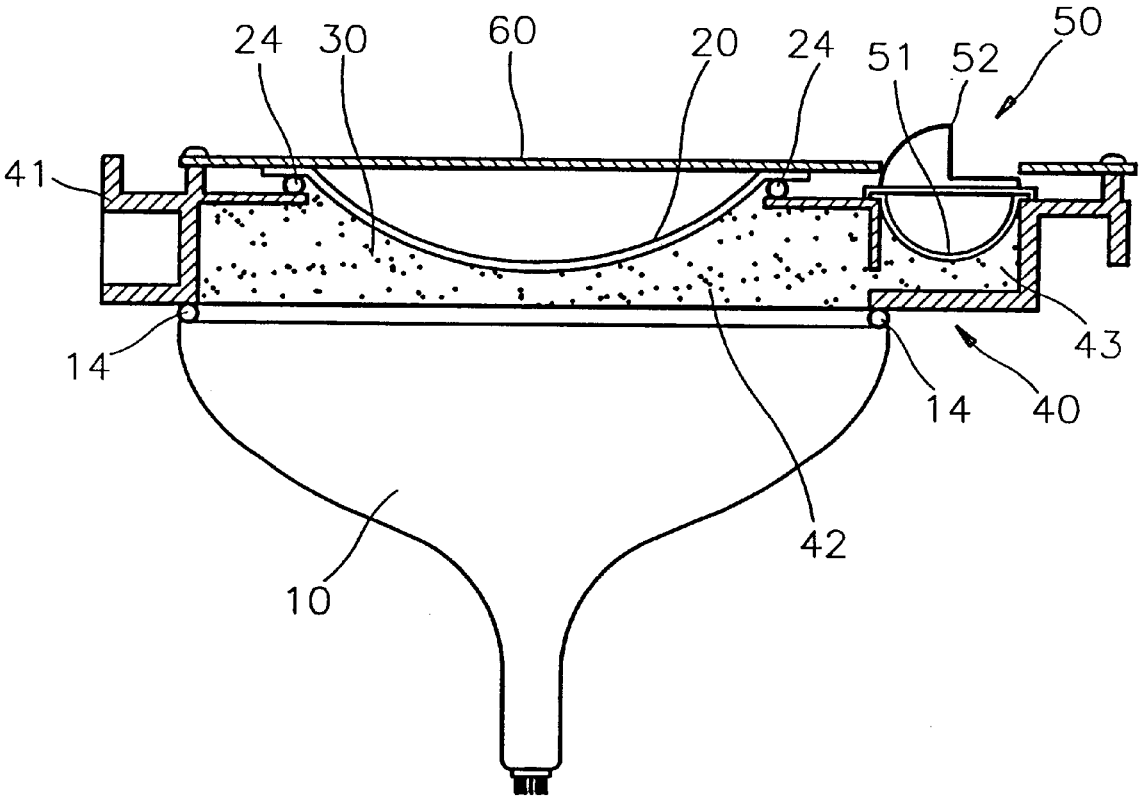
FIG. 1 (PRIOR ART)
FIG. 1 is a sectional view illustrating a CRT assembly adopting a conventional coolant buffering apparatus.
Figure 2:
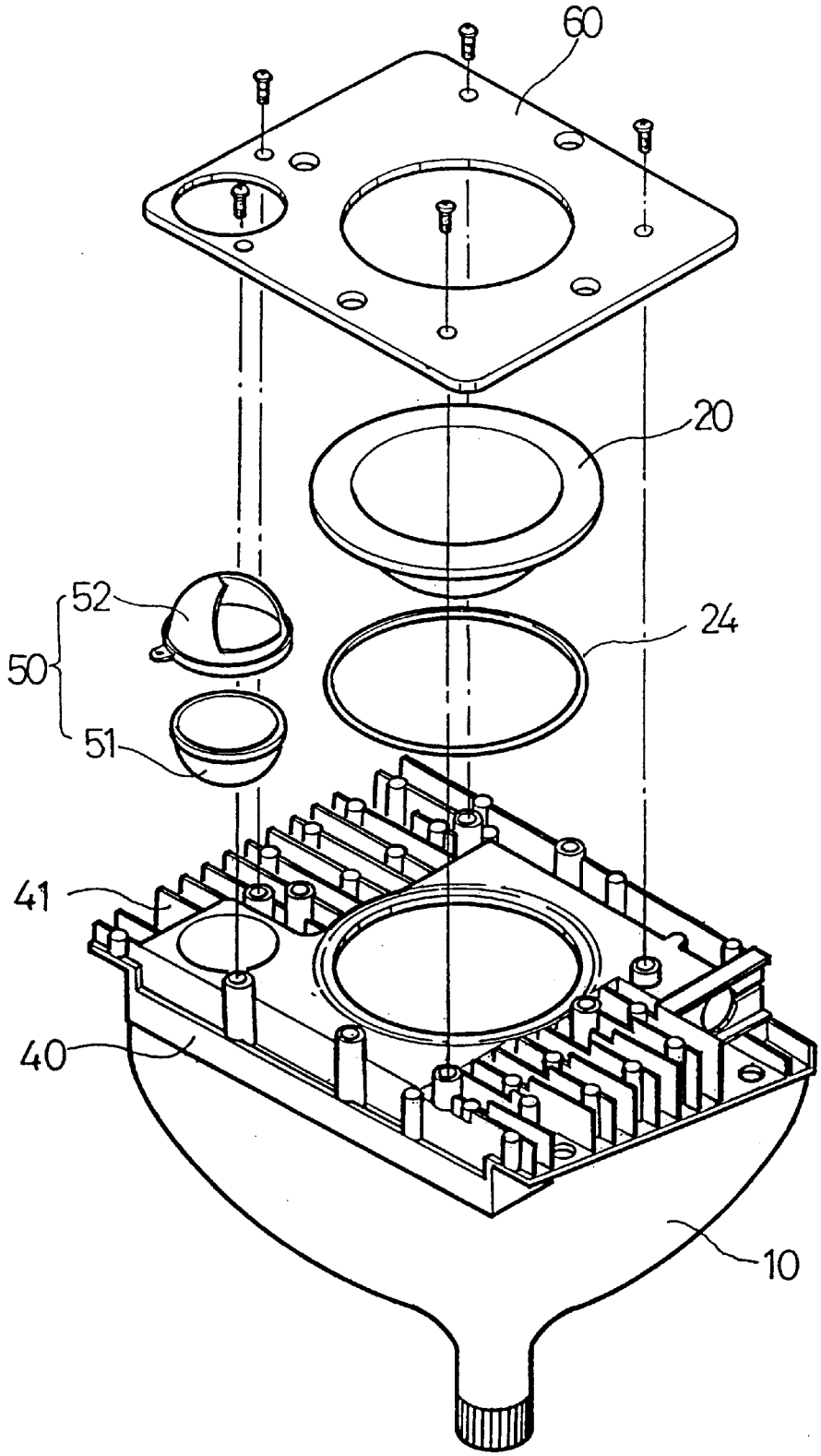
FIG.2 (PRIOR ART)
FIG. 2 is an exploded perspective view illustrating the CRT assembly of FIG. 1.
Figure 3:
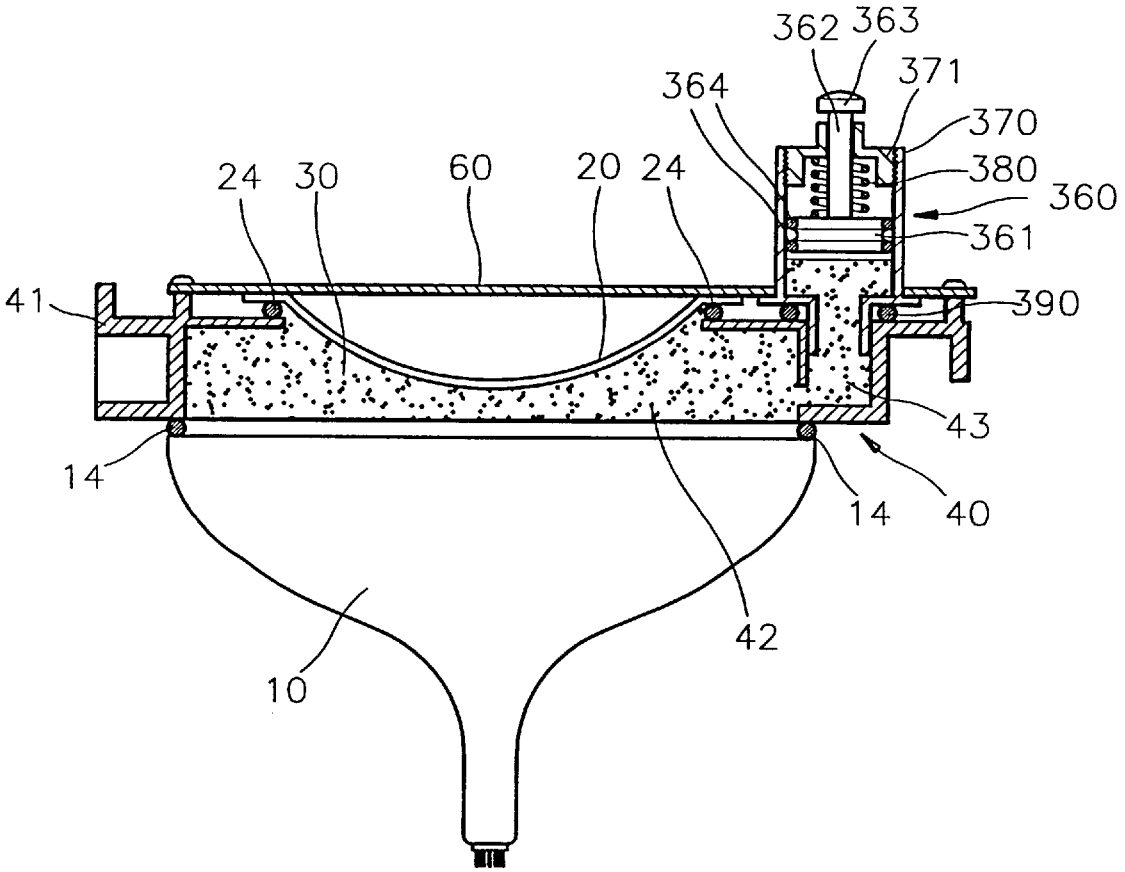
FIG. 3 is a sectional view illustrating a CRT assembly adopting a coolant buffering apparatus according to the present invention.
Figure 4:
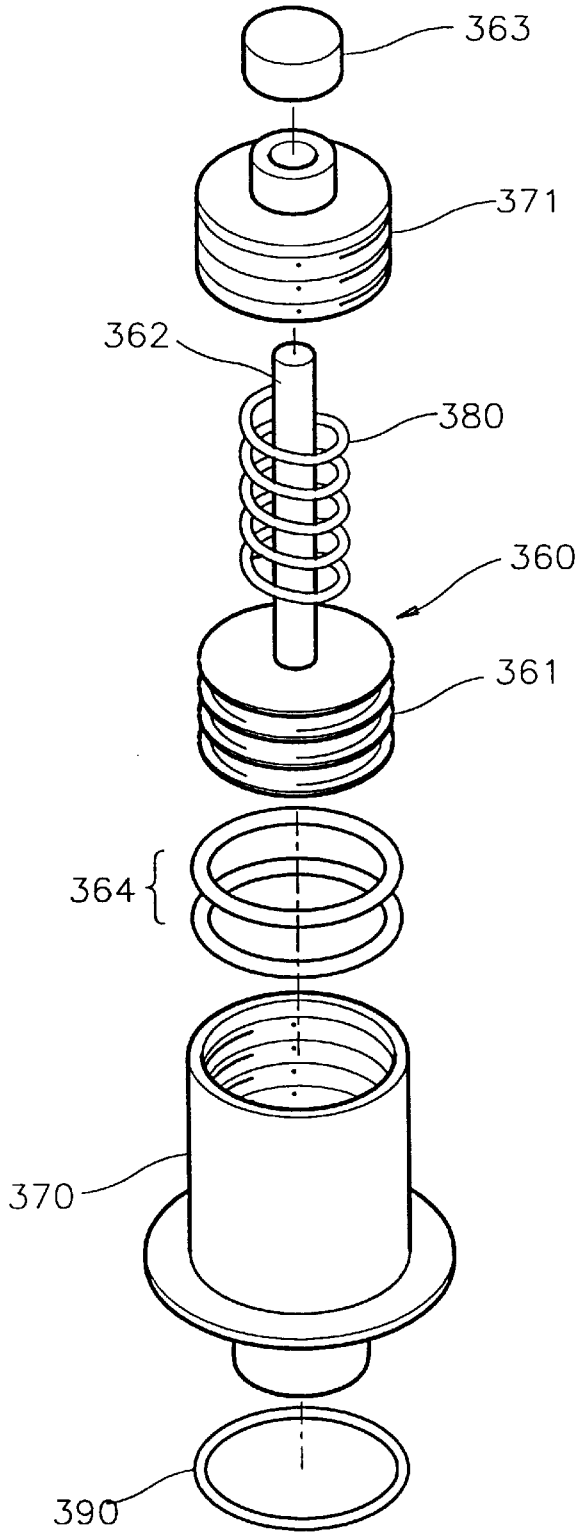
FIG. 4 is an exploded perspective view illustrating the coolant buffering apparatus of the present invention.

In the description below with reference to FIGS. 3 and 4, the same reference numerals as those used in the description with reference to FIGS. 1 and 2 indicate the same elements having the same functions. Referring to FIGS. 3 and 4, a coolant buffering apparatus of a CRT assembly according to the present invention includes a coupler 40 disposed between a CRT 10 and a projection lens unit 20. The coupler 40 has a plurality of radiating fins 41 formed on the outer surface of the coupler 40 and a containing portion 42 for containing a coolant 30 is formed inside the coupler 40. Rubber rings 14 and 24 forming a seal are disposed between the CRT 10 and the coupler 40, and the coupler 40 and the projection lens unit 20, respectively. The coolant 30 is injected via an inlet (not shown) formed by piercing the coupler 40 and the inlet is sealed by an additional sealing means (not shown).

In the coolant buffering apparatus according to the present invention, a coolant buffering means, capable of repeated expansions and contractions according to changes in the temperature of the coolant 30 is provided in a buffer path 43 connected to the coupler 40. The coolant buffering means includes a piston assembly 360, a cylinder 370 and a spring 380.

The piston assembly 360 includes a piston head 361, a rod 362, and a cap 363. The piston head 361 reciprocates along the longitudinal axis of the cylinder 370 in contact with the inner circumferential surface of the cylinder 370, to compensate for expansion and contraction forces of the coolant 30.

The rod 362 has a first end connected to the piston head 361 and a second end protruding outward piercing a cylinder cover 371. The cap 363 is inserted around and fixed to the second end of the rod 362. The cylinder 370 has one end inserted into the buffering path 43 of the coupler 40. A rubber ring 390 is disposed between the coupler 40 and the cylinder 370 to seal the union. Spring 380 is installed between the cylinder cover 371 and the head 361 to elastically bias the piston assembly 360 toward the head 361 when the coolant 30 contracts.

Piston rings 364 are installed about the periphery of the piston head 361, providing contact with the inner circumferential surface of the cylinder 370, to prevent the coolant 30 from leaking. A sealing bracket 60 is provided for mounting the coolant buffering apparatus to the coupler 40.

According to the present invention, in the coolant buffering apparatus of a CRT assembly having the above structure, when the temperature of the coolant 30 rises during operation of the CRT assembly, the coolant expands and pushes the head 361 of the piston assembly 360 in a direction away from said coupler 40 overcoming an elastic force of the spring 380 to lower the pressure in the coupler 40. Meanwhile, when the operation of the CRT assembly is stopped and the coolant 30 cools, the head 361 of the piston assembly 360 returns to its original position due to the elastic force of the spring 380.

As described above, in the coolant buffering apparatus of a CRT assembly according to the present invention, since the piston assembly 360 buffers expansions and contractions of the coolant 30 while reciprocating along the cylinder 370 by an elastic force of the spring 380, the coolant buffering apparatus exhibits superior endurance and improved reliability.

It is noted that the present invention is not limited to the preferred embodiment described above, and it is apparent that variations and modifications by those skilled in the art can be effected within the spirit and scope of the present invention defined in the appended claims.

What is claimed is:

1. A coolant buffering apparatus of a cathode ray tube (CRT) for buffering expansions and contractions of a coolant held in a coupler installed between said CRT and a projection lens unit, said coolant buffering apparatus comprising:

a cylinder with a first end and a second end, said first end connected to said coupler so that said coolant in said coupler can flow into said cylinder;

a piston assembly installed to be operative to reciprocate in said cylinder to be pushed in a direction away from said coupler in said cylinder as said coolant expands; and a spring for elastically biasing said piston assembly toward said coupler as said coolant contracts.

2. The coolant buffering apparatus of a CRT as claimed in claim 1, further comprising a cylinder cover coupled to the second end of said cylinder.

3. The coolant buffering apparatus of a CRT as claimed in claim 1, further comprising a rubber ring disposed between said coupler and said first end of said cylinder to seal the union of said coupler and said cylinder.

4. The coolant buffering apparatus of a CRT as claimed in claim 1, wherein said piston assembly comprises:

a piston head;

a rod with a first end and a second end, said first end coupled to said piston head and said rod reciprocating in said cylinder; and a cap inserted around and fixed to the second end of said rod.

5. The coolant buffering apparatus of a CRT as claimed in claim 4, further comprising at least one piston ring provided at an outer circumferential surface of said piston head which contacts an inner circumferential surface of said cylinder to prevent said coolant from leaking.

6. The coolant buffering apparatus of a CRT as claimed in claim 1, wherein said piston assembly comprises:

a piston head, and at least one piston ring provided at an outer circumferential surface of said piston head, wherein said at least one piston ring contacts an inner circumferential surface of said cylinder to prevent said coolant from leaking between said piston head and said cylinder.

* * * * *